US010349813B2

(12) United States Patent
Savignac

(10) Patent No.: US 10,349,813 B2
(45) Date of Patent: Jul. 16, 2019

(54) PERSONAL GROOMING DEVICE

(71) Applicant: Jay Savignac, Whitewater, WI (US)

(72) Inventor: Jay Savignac, Whitewater, WI (US)

( * ) Notice: Subject to any disclaimer, the term of this patent is extended or adjusted under 35 U.S.C. 154(b) by 303 days.

(21) Appl. No.: 15/353,510

(22) Filed: Nov. 16, 2016

(65) Prior Publication Data

US 2017/0188791 A1 Jul. 6, 2017

Related U.S. Application Data

(60) Provisional application No. 62/255,609, filed on Nov. 16, 2015.

(51) Int. Cl.
*A47L 25/00* (2006.01)
*A47L 25/08* (2006.01)

(52) U.S. Cl.
CPC ..... *A47L 25/08* (2013.01); *A47L 25/005* (2013.01)

(58) Field of Classification Search
CPC ..... A47L 25/08; A47L 25/005
See application file for complete search history.

(56) References Cited

U.S. PATENT DOCUMENTS

| | | | | |
|---|---|---|---|---|
| 2,401,842 | A | 6/1946 | Slater | |
| 2,423,962 | A | 7/1947 | Clerk et al. | |
| 2,624,060 | A | 1/1953 | McKenzie | |
| 2,702,913 | A | 3/1955 | Walkama | |
| 3,343,194 | A | 9/1967 | Ramelson | |
| 3,421,170 | A | 1/1969 | Thomas | |
| 3,623,179 | A * | 11/1971 | Roth | A47L 25/005 15/104.001 |
| 4,361,923 | A | 12/1982 | McKay | |
| 4,399,579 | A | 8/1983 | McKay | |
| 4,422,201 | A | 12/1983 | McKay | |
| 4,557,011 | A * | 12/1985 | Sartori | A47L 25/005 15/104.002 |
| 4,979,257 | A | 12/1990 | Heneveld | |
| 6,055,695 | A | 5/2000 | McKay | |
| 6,427,278 | B1 | 8/2002 | McKay | |
| 6,449,794 | B1 | 9/2002 | Jaffri | |
| D467,736 | S | 12/2002 | Russell | |
| 6,688,464 | B2 | 2/2004 | Jessen et al. | |
| 7,114,213 | B2 | 10/2006 | DeRoma | |
| 7,841,036 | B2 | 11/2010 | Smith | |
| 7,856,690 | B2 | 12/2010 | Tuman et al. | |
| D656,319 | S | 3/2012 | Kye et al. | |

(Continued)

*Primary Examiner* — Randall E Chin
(74) *Attorney, Agent, or Firm* — Gary L. Eastman, Esq.; Eastman McCartney Dallmann LLP

(57) ABSTRACT

A personal grooming device designed to loosen and remove dirt and other debris from the surface of a material, such as a shirt or jacket. The grooming device comprises a handle, an inner cage fixedly attached to the handle and sized to receive a travel-size lint roller, an outer cage sized to fit over the travel-size lint roller, and an outer sleeve made from moleskin sized to fit around the outer cage. The outer sleeve may be constructed from an piece of adhesive-backed material wrapped around the outer cage or a single piece of cylindrical material sized to snuggly fit around the external cage. The outer sleeve may be made from other materials. In use, the sleeve loosens debris from a surface after which the external cage with sleeve is removed to expose the lint roller. The lint roller then picks up the loosed dirt and debris.

15 Claims, 10 Drawing Sheets

(56) References Cited

U.S. PATENT DOCUMENTS

| | | | |
|---|---|---|---|
| D691,378 | S | 10/2013 | Taub |
| 8,763,190 | B2 | 7/2014 | Ross |
| 2007/0204416 | A1 | 9/2007 | Treacy |
| 2013/0205522 | A1 | 8/2013 | Butts |

* cited by examiner

PERSONAL GROOMING DEVICE

RELATED APPLICATIONS

This utility patent application claims the benefit of priority to U.S. Provisional Patent Application Ser. No. 62/255,609 entitled "Personal Grooming Device", filed on Nov. 16, 2015.

FIELD OF THE INVENTION

The present invention pertains generally to a hand tool for use in garment care. More particularly, the present invention pertains to a personal care product for removing lint from garments and other surfaces. The Present invention is particularly, but not exclusively, useful as a combination debris remover and lint roller.

BACKGROUND OF THE INVENTION

A lint brush is a tool for removing lint accumulated on clothing, upholstery, or other surfaces. There are different models of both travel size and full size rollers. In addition to lint, this brush can be used to pick up other types of debris that cling to garments, such as dust, dirt, or pet fur. Prior to the existence of lint rollers, a person would remove lint from clothing by wrapping their hand with tape, where the sticky side points out, then brush their hand across the surface to pick up any lint or other debris. Clothes brushes were also used to clean and remove lint from clothes.

Typically, a lint brush, sometimes referred to as a lint roller, consists of a handle and a barrel extending from the handle. The barrel is sized to receive a roll of paper with an adhesive applied to one side of the paper roll. In some lint rollers, the barrel is rigidly attached to the handle and the roll of paper rotates around the barrel. In other rollers, the barrel is rotatably attached to the handle so that the roll of paper and the barrel rotate together relative to the handle. Typically, the adhesive is light in nature in that it is sticky enough to pick up lint and other light debris but will not stick to the garment or surface, nor will it stick to the individual layers of the roll of paper so that each layer of paper may easily be pulled off to expose a clean layer of adhesive covered paper. In use, after a clean section is exposed, the lint roller is rolled over a surface to pick up debris. When the lint roller surface is no longer sticky, the outer-most layer is peeled off to reveal a clean layer underneath. After a roll is used, the roll is replaced with a fresh roll.

Another type of lint brush more closely resembles a hair brush, but instead of bristles, one end is covered with a special fabric designed to attract and hold dust and lint. This type of lint brush is used by brushing the brush in only one direction over a surface, thereby trapping debris within the structure of the brush fabric. The brush is then cleaned by brushing the brush opposite the direction used to collect and trap the debris, where the debris is pulled from the structure of the fabric. To make this style of lint brush as user friendly as possible, many brush models are reversible in that the brush head swivels or the head has two sides, each side having the brush fabric pointing in opposite directions.

It is commonly believed that Nicholas McKay from the United States invented the first lint remover in 1956. McKay was an American inventor and entrepreneur best known for his first commercial product, the Lint Pic-Up. McKay had the idea after using masking tape, a paper roll, and some wire to clean his suit before chaperoning his son's high school dance in 1956. He and his late wife Helen formed Helmac the next day, which eventually held 92% of the American market for lint rollers in 1996, However, numerous patents have been filed years earlier for lint rollers and brushes, most notably by Charles F Slater and Homer T Clark, who both filed patents in the US for lint rollers.

An example of earlier patent filings for lint rollers is U.S. Pat. No. 2,401,842, entitled "Rotary Cleaner Roll and Container therefor", issued to C. F. Slater on Jun. 11, 1946. This patent discloses an elongated tube with an adhesive roll wrapped around the center area of the roll. The combination of elongated tube with the adhesive roll is sized to fit into a protective cylinder with a removable cap at one end. To use the invention, a user removes the tube with adhesive roll from the protective cylinder, then holds the tube at either end to roll it over a surface to pick up lint and other debris.

Another example of an early patent filing is U.S. Pat. No. 2,423,962, entitled "Lint Remover", issued to Homer T. Clark and Carl J. Paterson on Jul. 15, 1947. This patent discloses a holder having a roll of adhesive tape mounted inside the holder such that the roll of tape is exposed above the edges of the holder. A user removes the cover from the holder then rolls the invention over a surface thereby removing lint and debris. As with other lint rollers, a user must expose a fresh layer of tape when dust and debris sufficiently cover the surface of the current layer. As with other inventions of this size, a user will need to expose many layers due to the reduced surface area of a travel-size lint roller.

Yet another example of a lint roller is U.S. Pat. No. 2,642,060, entitled "Rotary Adhesive Roll Fabric Cleaning Device", issued to T. R. Mckenzie on Jan. 6, 1953. This patent discloses a frame configured to receive a roll of adhesive backed material usable to remove lint and debris from a surface. In some embodiments, the frame is a wire frame formed with section that allows a user to place the invention on a surface without the surface of the adhesive roll touching the surface. In other embodiments, the frame is a single piece of molded plastic with a hood that allows a user to place the invention on a surface without the adhesive contacting a surface. This invention fails to disclose the use of a cover or other configuration allowing the invention to be used in a travel environment.

A more recent patent related to lint rollers is U.S. Pat. No. 7,114,213, entitled "Free Standing Lint Roller with Case", which issued to Flavio DeRoma on Oct. 3, 2006. This invention discloses a decorative lint roller having a handle and a rotatable barrel extending from the handle. A roll of lint paper is slid over the barrel thereby enabling the user to roll the adhesive roll to pick up lint and other debris. When not in use, the roll of lint paper is inserted into a decorative case that matches the shape and form of the handle. This invention fails to disclose a travel-sized version.

What is needed in the industry is a lint roller configurable for use as a tool to loosen any foreign substance or material from a surface as well as a lint roller to pick up and remove lint or other material.

SUMMARY OF THE INVENTION

A preferred embodiment of the present invention is a personal care product useful as both a tool to loosen material from a cloth surface and a lint roller useful to pick up and remove lint and other material from the cloth surface depending on the needs of the user. In a first preferred embodiment, the personal care product consists of a handle portion and a first barrel portion fixedly attached to the handle portion along the handle's central axis. An adhesive-backed lint roll is then slid over the first barrel portion thereby creating a lint roller. The internal diameter of the lint roll is slightly larger than the first barrel portion, thereby allowing the lint roll to rotate around the barrel during use. Also included in the first preferred embodiment is a cover configured to fit over the lint roller, thereby protecting the adhesive surface of the lint roll when not in use. When installed over the lint roller, the cover is configured to engage the interior of the barrel portion such that the cover will not rotate in relation to the handle. To further enhance the usability of the personal care product of the present invention, the cover s sized to receive an adhesive-backed abrasive material sheet, such as a moleskin sleeve, useful to loosen foreign material and lint from a surface. In preferred embodiments, the sleeve is made from moleskin or a moleskin like material. In alternative embodiments, the sleeve is made from rubber, cloth, or other material capable of freeing debris and other contaminants from the surface. The sleeve may be a section of material, such as moleskin or rubber, having an adhesive back and sized so the sleeve may be applied around the outside of the cover. The sleeve may also be a prefabricated cylindrical sleeve sized to snuggly fit over the outside of the cover. After using the moleskin sleeve to loosen material, the cover and sleeve are removed to avow use of the lint roller, thereby increasing the efficiency of the invention.

In an additional embodiment of the present invention, an abrasive coating on the outer surface of the cage aids in loosening foreign material and lint from a surface. The abrasive coating is applied with a spray that creates a uniform upright deposit of fibers on the outer surface of the protective cage which, when used in conjunction with the cage, provides an additional benefit in dislodging foreign material and lint from a surface. The sprayed on fibers are electrostatically painted on the outer surface of the cage. The abrasion resistant fibers sprayed onto the cage include but are not limited to nylon, polyester, Kevlar®, and Spectra®. Due to the electrostatically painting of the spray, the deposit of fibers adheres to the outer surface of the cage and is able to withstand countless uses without degradation of the abrasive coating. By application of the abrasive coating, the user can make use of the cage without the need for the outer moleskin cover. Without the moleskin cover, the overall size of the present invention is reduced while still providing the user with the same functionality due to the deposition by the abrasive coating. The abrasive coating also provides an additional benefit over the moleskin in removal of antiperspirant residue or other foreign objects from the surface of the clothing of the user.

In other embodiments of the present invention, the handle and barrel are formed as a single piece.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
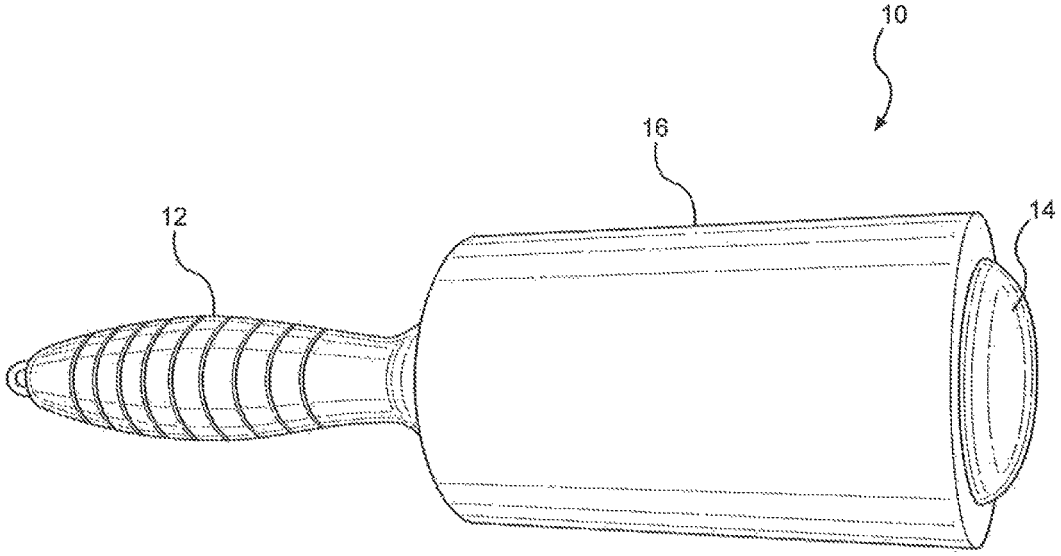
FIG. 1 PRIOR ART
FIG. 1 is a perspective view of a prior art lint roller.

Referring initially to FIG. 1, a perspective view of a lint roller is shown and generally referred to as 10. Lint roller 10 consists of a handle 12, a shaft (not shown) for supporting lint roll 16, and an end cap 14 connected to the shaft (not shown) for holding lint roll 16 in place during use. To use lint roller 10, a user holds lint roller 10 by the handle 12 then rolls the lint roll 16 across a surface to pick up and remove lint and other debris. Lint roll 16 typically consists of multiple layers of adhesive paper where one layer may be removed, thereby exposing an unused layer, after it has become covered in lint and debris. After using the last layer of lint roll 16, any remaining portion of lint roll 16 may be removed from the handle 12 and shaft (not shown) and a new lint roll 16 installed onto the shaft (not shown). Without a cover, lint roller 10 may become saturated with debris while being stored, such as in a bag or suitcase.

Figure 2:
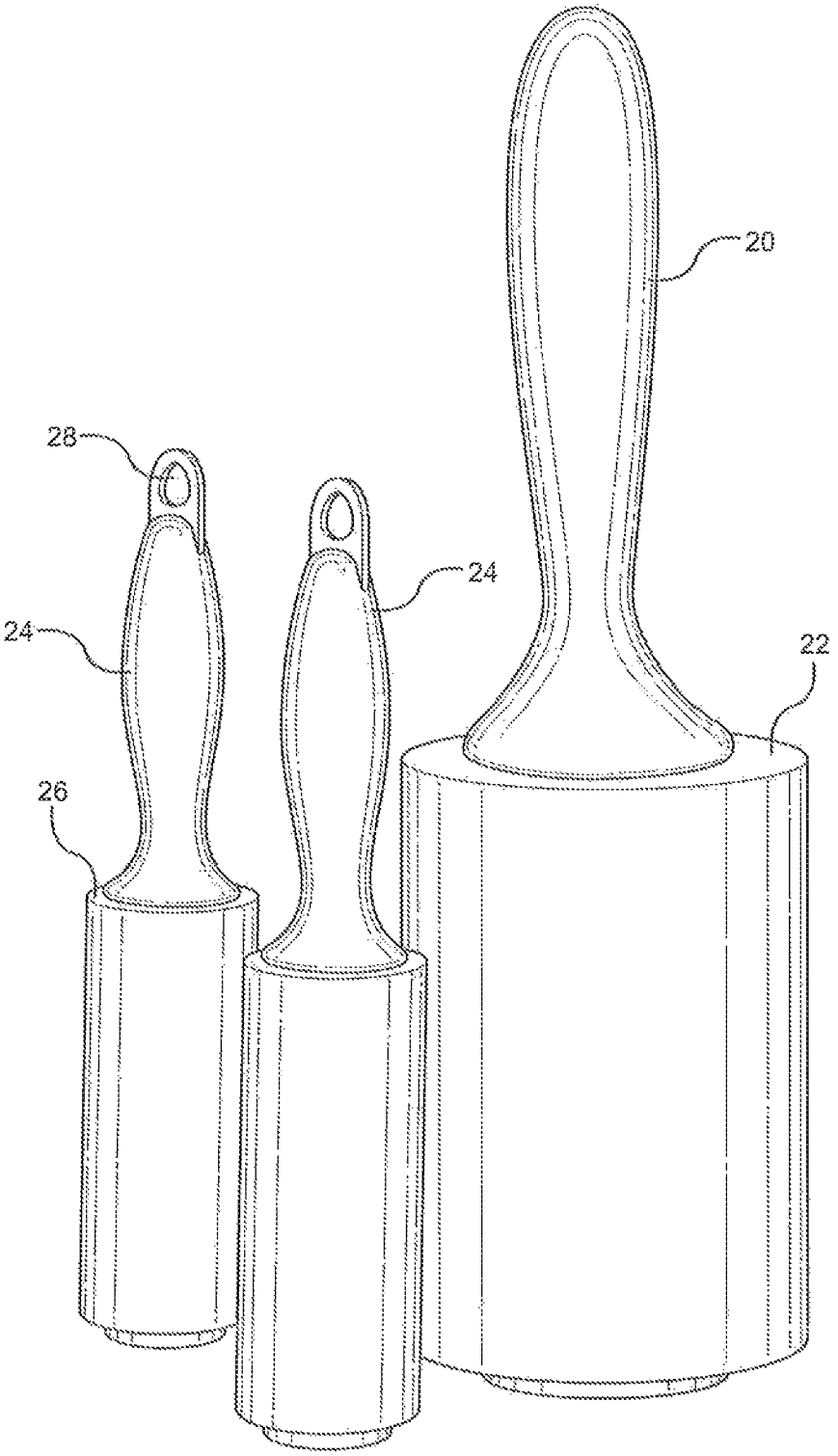
FIG. 2 PRIOR ART
FIG. 2 is a front view of prior art full-size and travel-size lint rollers.

FIG. 2 is a front view of a full-size roller 20 and two travel-size lint rollers 24. Full size roller 20 consists of a large adhesive lint roll 22. Travel-size lint rollers 24 consist of a travel-sized lint roll 26 and an eyelet 28. As can be seen in FIG. 2, lint rollers are either full-sized or travel-sized, with no way to mix the lint rolls.

Figure 3:
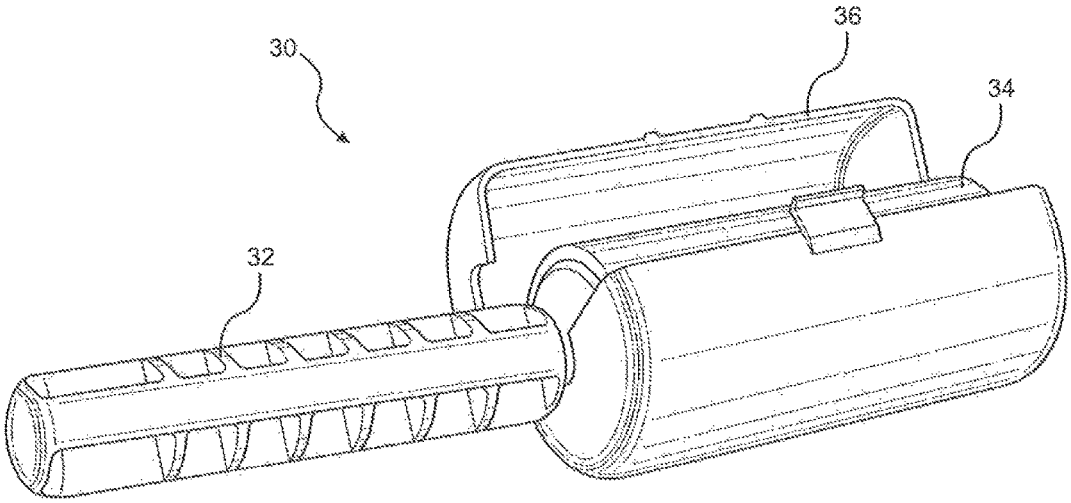
FIG. 3 PRIOR ART
FIG. 3 is a perspective view of another prior art travel-size lint roller having a removable clamshell cover.

FIG. 3 is a perspective view of a lint roller and is generally referred to as 30. Lint roller 30 consists of a handle with a rotating shaft 32, a lint roll 34, and a clamshell cover 36. Lint roll 34 attaches to handle with rotating shaft 32 such that lint roll 34 rotates with respect to the handle portion of handle with rotating shaft 32. When not in use, clamshell cover 36 is closed around lint roll 34 thereby protecting the lint roll 34 from becoming covered in lint and other debris. To use lint roller 30, a user removes clamshell cover 36 to expose the adhesive surface of lint roll 34. The user then rolls the lint roll 34 across a surface to lift off any lint or debris. When the surface of the lint roll 34 becomes filled with lint or debris, the user peels off the outmost layer of lint roll 34 to expose a clean layer. After using lint roller 30, the user closes clamshell cover 36 around lint roll 34 thereby protecting lint roll 34.

Figure 4:
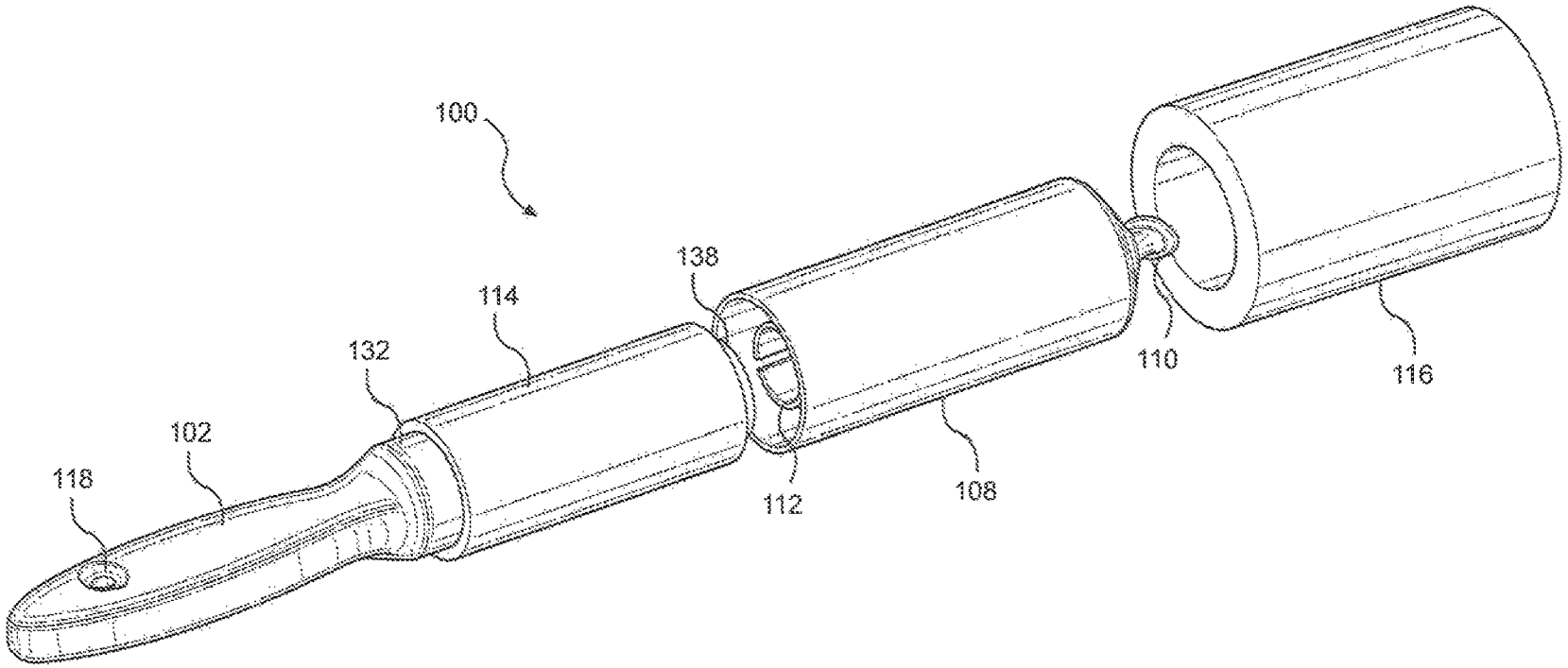
FIG. 4 is an exploded perspective view of a preferred embodiment of the present invention.

Moving now to FIG. 4, an exploded perspective view of a preferred embodiment of the personal care product of the present invention is shown and referred to as 100. Personal care product 100 consists of a handle 102, a lint paper holder 104 (not shown, see FIGS. 8 and 9) having retention tabs 138 and a collar 132, an external cage 108 having an interior cage 112 affixed therein and a grip 110, a travel-size lint roll 114 and a moleskin sleeve 116. It is to be appreciated by someone skilled in the art that other materials may be used to form the sleeve, including moleskin-like material or rubber. Specific details and features of personal care product 100 will be discussed in detail below.

Moleskin is a heavy cotton fabric, woven then sheared to create a short, soft pile on one side. In preferred embodiments, moleskin sleeve 116 is constructed from a single piece of material where the side opposite the soft pile is coated with an adhesive used to hold the moleskin sleeve 116 in place during use, storage, and transport. The moleskin sleeve 116 is secured to the outer surface of cage 108 with the soft pile facing outward. In alternative embodiments of the present invention, the moleskin sleeve 116 is constructed from a single piece of cylindrical material sized to snuggly fit the outside of cage 108 such that the usable surface, such as the soft moleskin pile, is on the outside of the cylinder. In use of the preferred embodiment, moleskin sleeve 116 is used to free debris and other contaminants from a fabric's surface, after which, the cage 108 and moleskin sleeve 116 are removed from personal care device 100 so lint roll 114 may be used to pick up and remove the debris and other contaminants. In alternative embodiments of the present invention, sleeve 116 may be constructed from rubber, cloth, or other material capable of freeing debris and other contaminants from a surface.

Figure 5:
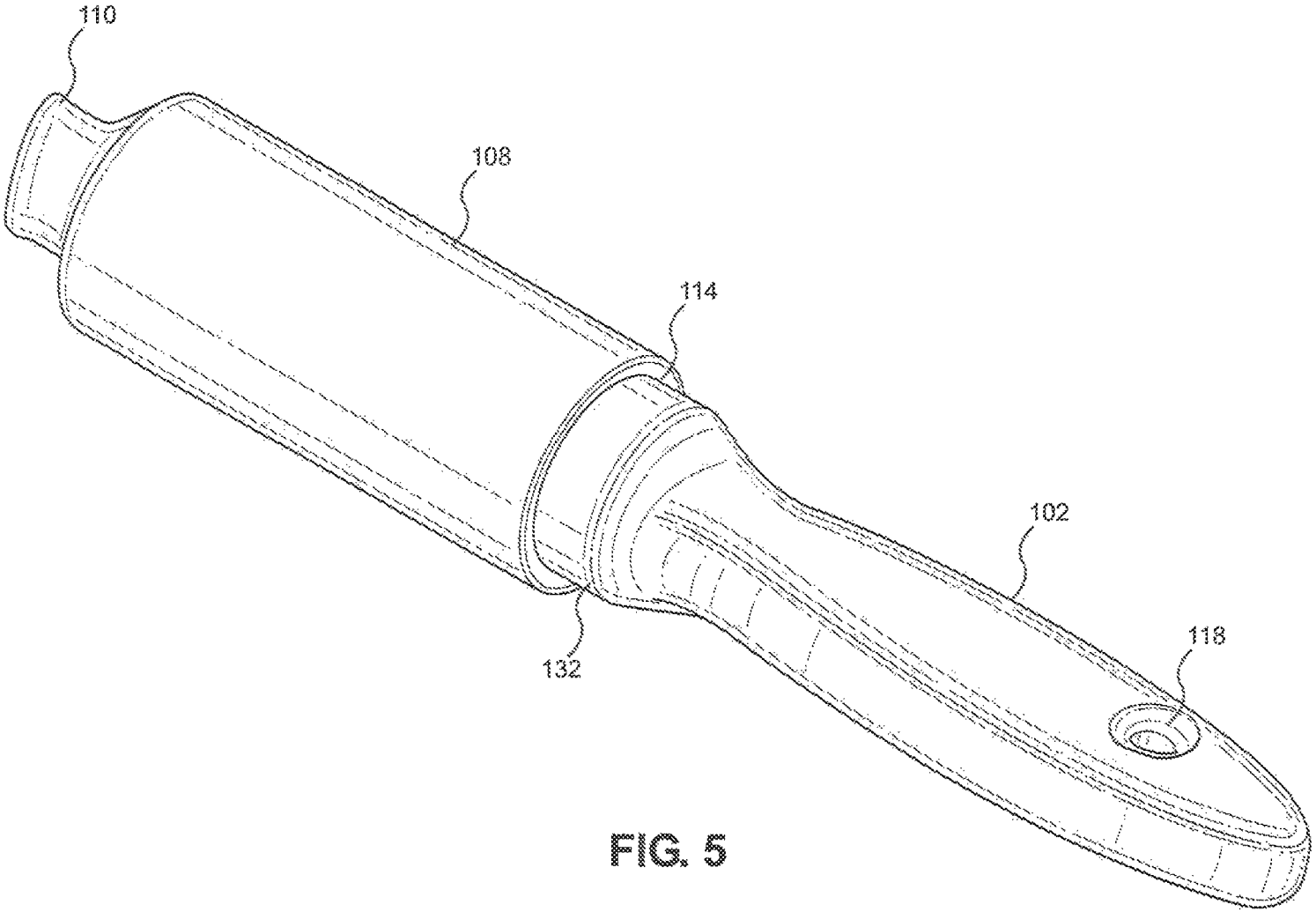
FIG. 5 is a perspective view of a preferred embodiment of the present invention configured for travel use.

Referring now to FIG. 5, a perspective view of a preferred embodiment of the present invention configured for travel use is shown. As shown in FIG. 5, external cage 108 is installed over lint roll 114, which is installed onto lint paper holder 104 (now shown in FIG. 8). Handle 102 consists of an eyelet 118 to allow for the attachment of a tether or the personal care product 100 onto a hook. In operation, a user pulls off cage 108 by pulling on grip 110. Cage 108 is configured such that the inside wall of cage 108 does not touch the adhesive surface of lint roll 114 when cage 108 is installed onto personal care product 100. Lint roll 114 rotates with respect to handle 102. After using personal care product 100, cage 108 is pushed onto lint roll 114 until cage 108 is fully seated. When the last layer of lint roll 114 is used, the empty roll is pulled until is slides off lint paper holder 104 (not shown). A new lint roll 114 is then pushed onto lint paper holder 104 (not shown) until lint roll 114 is fully seated when it makes contact with collar 132.

Figure 6:
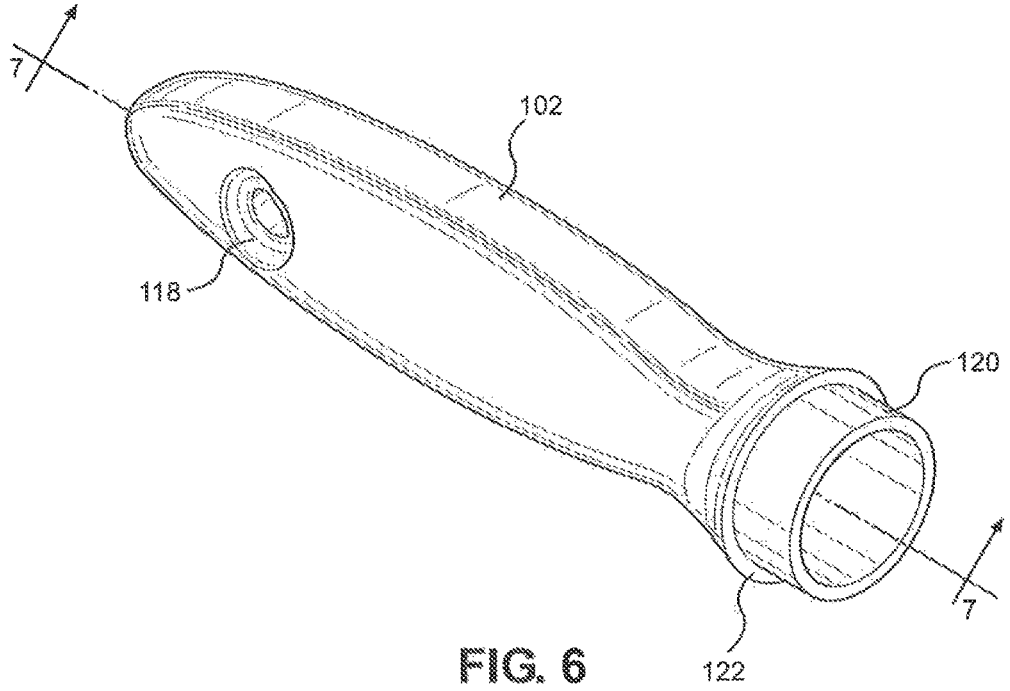
FIG. 6 is a perspective view of a handle from a preferred embodiment of the present invention.

Referring to FIG. 6, a perspective view of a handle from a preferred embodiment of the present invention is shown and referred to as 102. Handle 102 is made from any type of durable plastic. However, it is to be appreciated by someone skilled in the art that handle 102 made be made from any durable material including, but not limited to, metal such as aluminum, wood, or composite material such as carbon fiber and epoxy. In a preferred embodiment, handle 102 may be partially hollow or solid. Handle 102 consists of an eyelet 118, a guide cylinder 120, and a seat 122. Guide cylinder 120 aligns lint paper holder 104 (not shown) onto handle 102 until collar 132 (not shown in this figure, see FIGS. 5 and 8) reaches seat 122.

Figure 7:
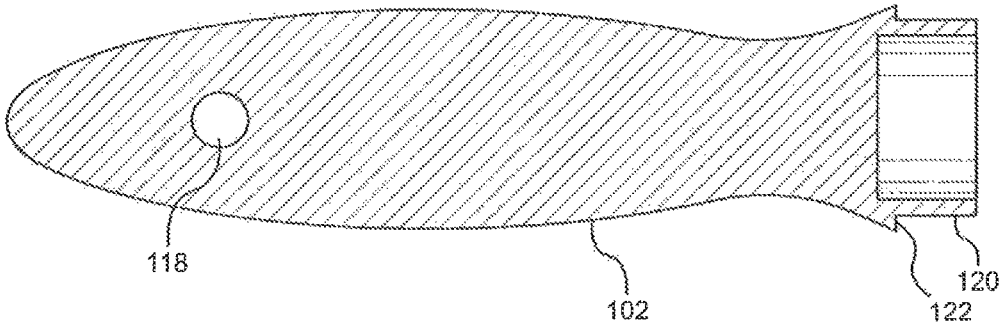
FIG. 7 is a cutaway view of the handle in FIG. 6.

FIG. 7 is a cutaway view along line 7-7 of FIG. 6. Shown is the general location of eyelet 118 on handle 102. Also shown is guide cylinder 120 and seat 122. In this embodiment, handle 102 is solid with the exception of the area defined by guide cylinder 120 and seat 122.

Figure 8:
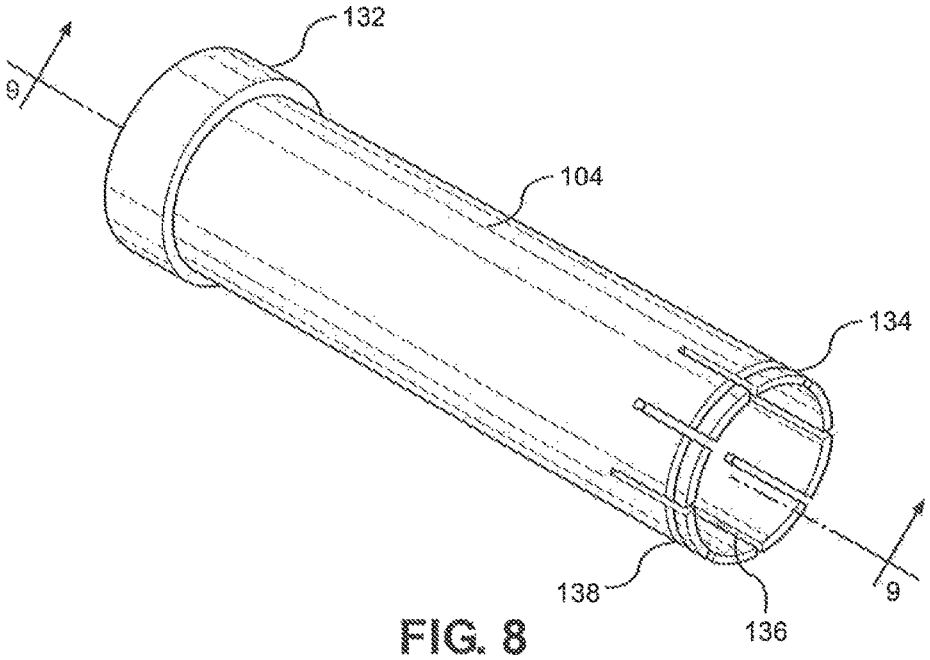
FIG. 8 is a perspective view of a lint paper holder from a preferred embodiment of the present invention.

FIG. 8 is a perspective view of a lint paper holder from a preferred embodiment of the present invention and referred to as 104. Lint paper holder 104 is formed in the shape of a cylinder having a collar 132 on one end and capture arms 134 on the other end. Capture arms 134 consist of a series of equally spaced slots 136 and retention tabs 138 used to hold lint roll 114 (not shown, see FIGS. 4 and 5) in place when installed onto lint paper holder 104. Due to the presence of slots 136, capture arms 134 compress inward when lint roll 114 is pushed onto lint paper holder 104 thereby allowing lint roll 114 to slide fully onto lint paper holder 104 until it reaches collar 132. When lint roll 114 is fully installed onto lint paper holder 104, capture arms 134 return to their normal position where retention tabs 138 prevent lint roll 114 from sliding off of lint paper holder 104 during use. Lint paper holder 104 is configured such that lint roll 114 rotates with respect to lint paper holder 104. When lint roll 114 is depleted, any remaining components of lint roll 114 are slid off lint paper holder 104 over retention tabs 138, and a new lint roll 114 installed in its place.

Figure 9:
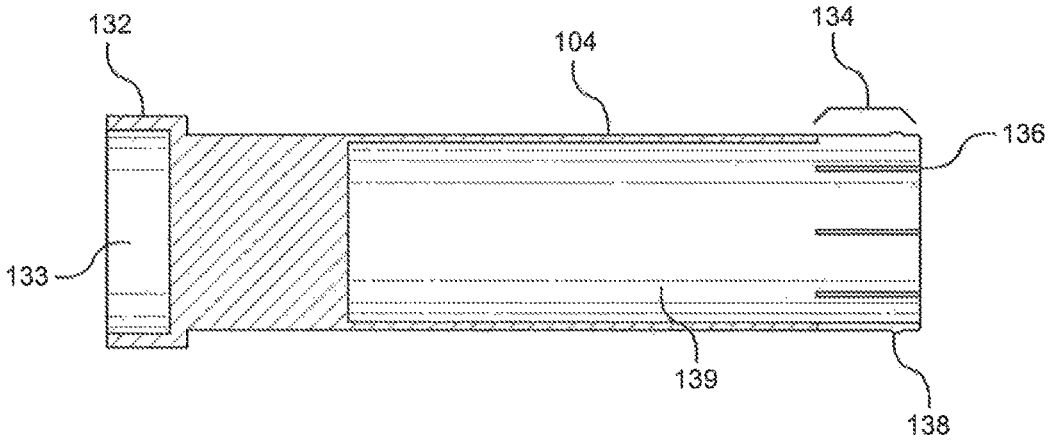
FIG. 9 is a cutaway view of the lint paper holder in FIG. 8.

FIG. 9 is a cutaway view of lint paper holder 104 along lines 9-9 of FIG. 8. Shown in FIG. 9 are lint paper holder 104, capture arms 134, slots 136, retention tabs 138, interior 139, collar 132, and seating area 133. Lint paper holder 104 is hollow thereby forming interior 139. Collar 132 and seating area 133 are sized to fit over guide cylinder 120 of handle 102 (see FIGS. 6 and 7). Interior 139 is sized to receive cage insert 112 (see FIGS. 12 and 13) of cage 108 (see FIGS. 10 and 11).

Figure 10:
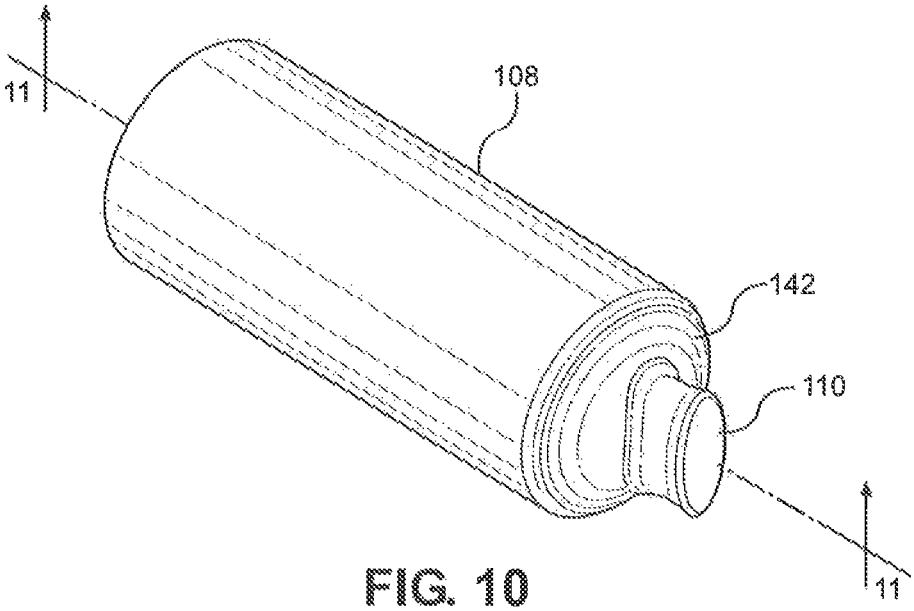
FIG. 10 is a perspective view of a cage from a preferred embodiment of the present invention.

Referring now to FIG. 10, cage 108 is shown. Cage 108 is a hollow cylinder having one end open and an end cap 142 on the other end. Located on end cap 142 is grip 110, which is gripped by a user to pull cage 108 off lint roll 114 (not shown, see FIGS. 4 and 5) for use.

Figure 11:
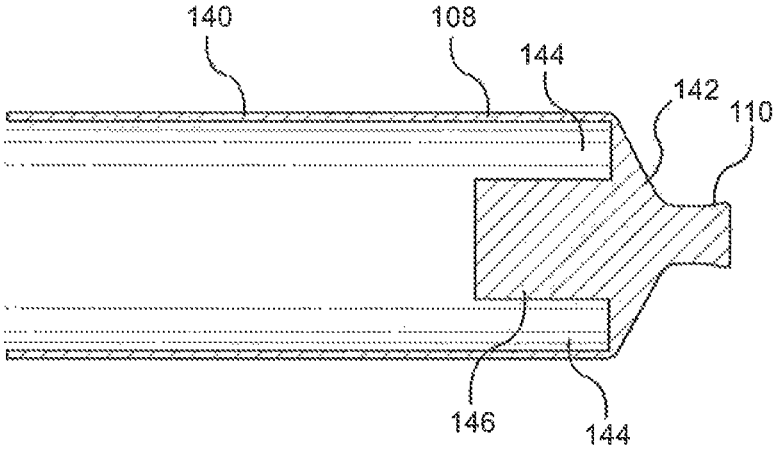
FIG. 11 is a cutaway view of the cage in FIG. 10.

FIG. 11 is a cutaway view of cage 108 as taken along lines 11-11 of FIG. 10. As shown in FIG. 11, cage 108 is open on one end and hollow throughout most of the cage's interior. Cage 108 consists of wall 140, end cap 142 with grip 110, and guide post 146. Between guide post 146 and wall 140 is void 144, which is configured to receive lint roll 114. Guide post 146 is sized to snugly receive cage insert 112 (not shown, see FIGS. 12 and 13). The length of cage 108 is sized to completely cover lint roll 114 (not shown, see FIGS. 4 and 5).

Figure 12:
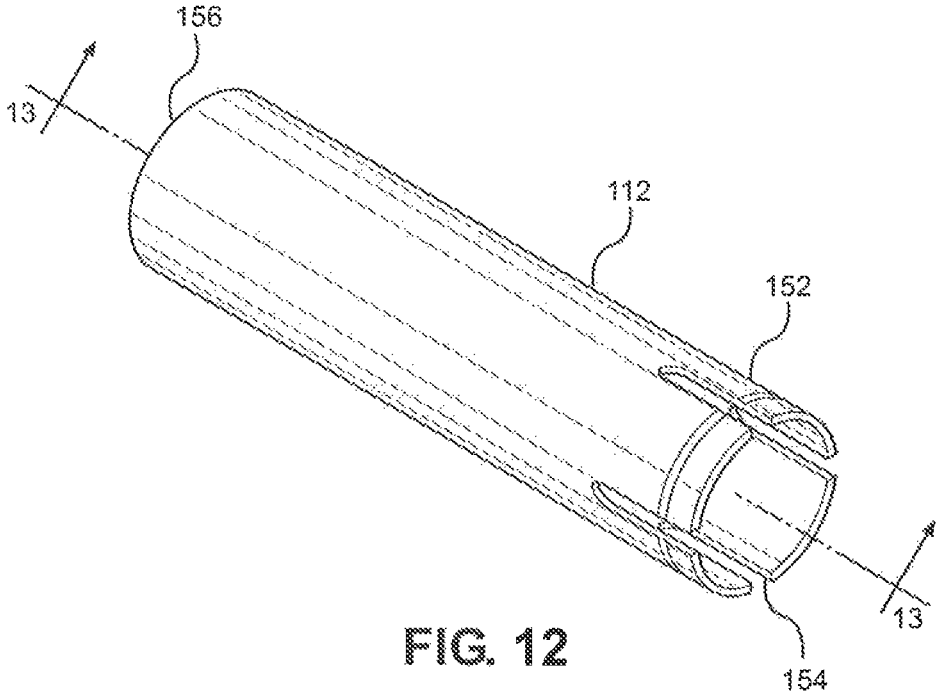
FIG. 12 is perspective view of a cage insert from a preferred embodiment of the present invention.

Referring now to FIG. 12, a perspective view of cage insert 112 is shown. Cage insert 112 is cylindrical and open on both ends. Cage insert 112 consists of capture arms 152 formed with slots 154 and end 156. In use, cage insert 112 is fixedly attached to the inside of cage 108 (not shown, see FIGS. 4, 5, 10, and 11). When cage 108 is installed over lint roll 114 (not shown, see FIGS. 4 and 5), cage insert 112 slides inside lint paper holder 104 thereby keeping lint roll 114 aligned with cage 108 and preventing the surface of lint roll 114 from contacting the interior surface of cage 108 (see FIG. 11). This allows for easy removal of cage 108 from lint roll 114.

Figure 13:
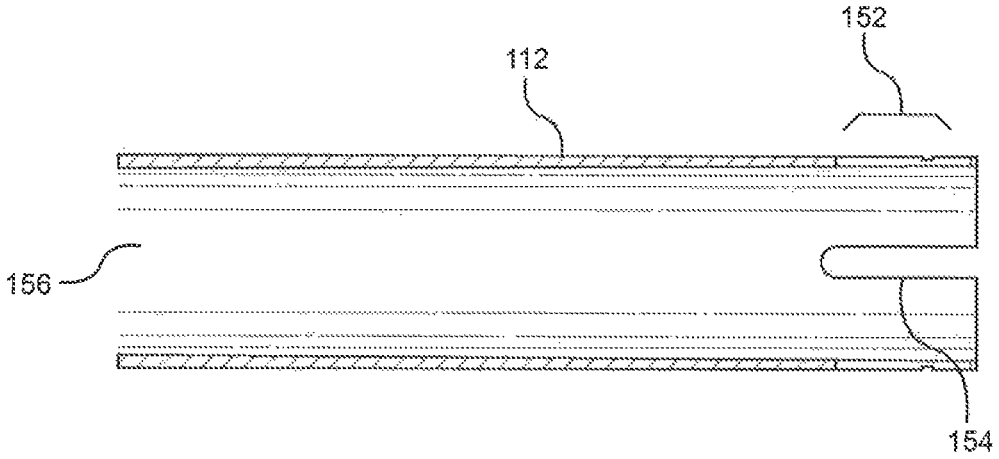
FIG. 13 is a cutaway view of the cage insert in FIG. 12 as taken along line 13-13.

Referring now to FIG. 13, a cutaway view of cage insert 112 taken along lines 13-13 of FIG. 12 is shown. Cage insert 112 is shown having capture arms 152, slots 154, and end 156.

In a preferred embodiment of the present invention, handle 102, lint paper holder 104, cage 108, and cage insert 112 are individual pieces. In the preferred embodiment, the individual pieces are made from durable plastic; however, other durable materials are fully contemplated. In alternative embodiments, handle 102 and lint paper holder 104 may be formed as one piece. Similarly, cage 108 and cage insert 112 may be formed on one piece with departing from the scope of the invention.

Figure 14:
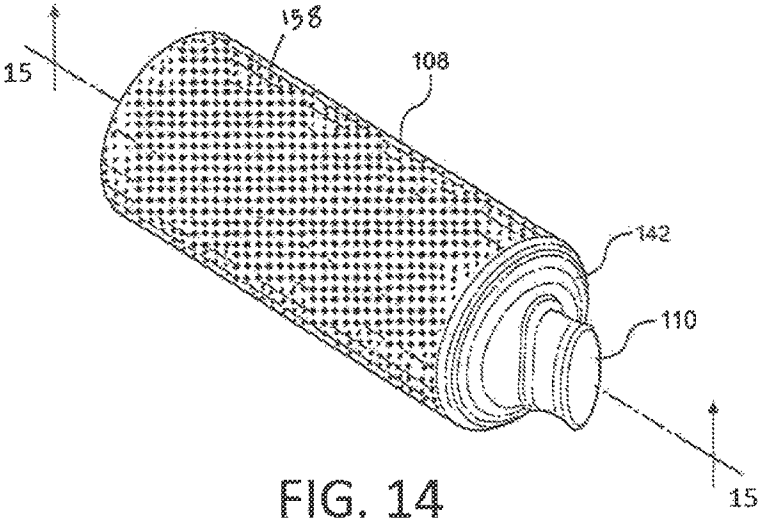
FIG. 14 is a perspective view of the cage insert in FIG. 12 with an abrasive coating on the outer surface.

FIG. 14 is a perspective view of cage 108 with abrasive coating 158 deposited on the outer surface. Cage 108 is a hollow cylinder having one end open and an end cap 142 on the other end. Located on end cap 142 is grip 110, which is gripped by a user to pull cage 108 off lint roll 114 (not shown, see FIGS. 4 and 5) for use.

Figure 15:
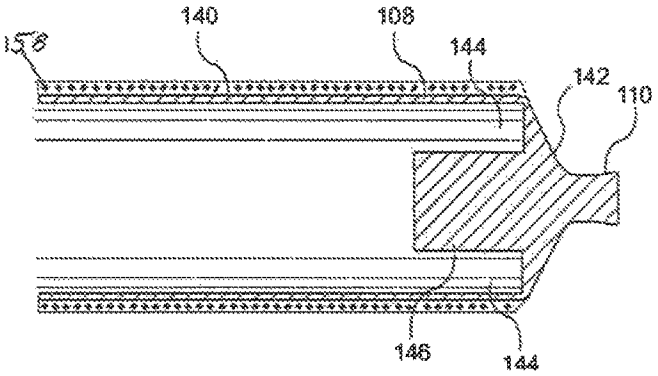
FIG. 15 is a cutaway view of the cage with the abrasive coating on the outer surface in FIG. 14 as taken along line 15-15.

FIG. 15 is a cutaway view of cage 108 as taken along lines 15-15 of FIG. 14. Cage 108 consists of wall 140, end cap 142 with grip 110, guide post 146, and abrasive coating 158. Between guide post 146 and wall 140 is void 144, which is configured to receive lint roll 114. Guide post 146 is sized to snugly receive cage insert 112 (not shown, see FIGS. 12 and 13). The length of cage 108 is sized to completely cover lint roll 114 (not shown, see FIGS. 4 and 5). The spray 158 is evenly deposited along the entire length of wall 140.

It is to be appreciated by someone skilled in the art that the different features disclosed in the preferred and alternative embodiments may be combined together to achieve the personal care product of the present invention.

While there have been shown what are presently considered to be preferred embodiments of the present invention, it will be apparent to those skilled in the art that various changes and modifications can be made herein without departing from the scope and spirit of the invention.

What is claimed is:

1. A personal grooming device, comprising:

a handle;

a lint paper holder fixedly attached to the handle;

an exterior cage having a wall, a closed end, and an open end;

a cage insert fixedly attached to the interior of the exterior cage; and a sleeve sized to snuggly fit over the exterior cage.

2. The personal grooming device of claim 1, further comprising a lint paper roll sized to fit over the lint paper holder.

3. The personal grooming device of claim 1, wherein the sleeve is constructed from moleskin.

4. The personal grooming device of claim 1, wherein the sleeve is constructed from rubber.

5. The personal grooming device of claim 1, wherein the exterior cage further comprises a grip located at the closed end.

6. The personal grooming device of claim 1, wherein the lint paper holder further comprises a plurality of capture arms formed into one end of the lint paper holder having slots formed between each capture arm, the end of each capture arm formed with retention tab, wherein the capture arms compress inward from a first position to a second position as a lint roll is installed onto the lint paper holder until the lint roll is fully installed.

7. The personal grooming device of claim 6, wherein the capture arms return to the first position after the lint roll is fully installed, and the retention tabs hold the lint roll on the lint paper holder during use.

8. The personal grooming device of claim 1, wherein the exterior cage further comprises:

a grip located on the exterior of the exterior cage's closed end;

a guide post disposed in the interior of the exterior cage opposite the grip where the guide post is sized to receive an end of the cage insert; and a void formed between the guide post and the exterior cage's wall, and sized to receive a lint roll.

9. The personal grooming device of claim 1, wherein the handle further comprises an eyelet.

10. The personal grooming device of claim 1, wherein the handle and the lint paper holder are formed as a single piece.

11. The personal grooming device of claim 1, wherein the cage and the cage insert are formed as a single piece.

12. The personal grooming device of claim 1, wherein the cage further comprises an abrasive coating on the outer surface.

13. The personal grooming device of claim 12, wherein the abrasive coating creates a uniform upright deposit of fibers on the cage to provide additional aid in removal of foreign materials.

14. A personal grooming device, comprising:

a handle;

a lint paper holder fixedly attached to the handle;

an exterior cage having a wall, a closed end, and an open end;

a cage insert fixedly attached to the interior of the exterior cage, wherein the exterior cage further comprises:

a grip located on the exterior of the exterior cage's closed end;

a guide post disposed in the interior of the exterior cage opposite the grip where the guide post is sized to receive an end of the cage insert; and a void formed between the guide post and the exterior cage's wall, and sized to receive a lint roll;

wherein the cage insert further comprises:

a first open end configured to attach to the cage's guide post; and a second open end having capture arms formed with slots, wherein the slots allow the capture arms to move inward, and wherein the cage insert is sized to snuggly fit inside the lint paper holder.

15. The personal grooming device of claim 14, wherein the cage insert, when installed onto the cage's guidepost, is configured to provide a consistent spacing between the surface of a lint roll and the cage's wall such that the surface of the lint roll does not touch the cage's wall when the cage is installed over, and removed from, the lint roll.

* * * * *